US007391399B2

(12) United States Patent
Kikuchi et al.

(10) Patent No.: US 7,391,399 B2
(45) Date of Patent: Jun. 24, 2008

(54) DISPLAY DEVICE

(75) Inventors: Hidenori Kikuchi, Chose (JP); Shinji Yasukawa, Shirako (JP); Hiroshi Watanabe, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 494 days.

(21) Appl. No.: 10/992,737

(22) Filed: Nov. 22, 2004

(65) Prior Publication Data

US 2005/0140630 A1 Jun. 30, 2005

(30) Foreign Application Priority Data

Nov. 20, 2003 (JP) ..... 2003-391014

(51) Int. Cl.
*G09G 3/36* (2006.01)

(52) U.S. Cl. ..... 345/89; 345/590; 345/204; 345/211

(58) Field of Classification Search ..... 345/690, 345/87–102

See application file for complete search history.

(56) References Cited

U.S. PATENT DOCUMENTS 6,535,189 B1 * 3/2003 Akiyama et al. ..... 345/87

* cited by examiner

*Primary Examiner*—Duc Q Dinh
(74) *Attorney, Agent, or Firm*—Antonelli, Terry, Stout & Kraus, LLP.

(57) ABSTRACT

The present invention provides a display device which can suppress the increase of a chip size while reducing the number of transistors of a decoder circuit compared to the prior art. Assuming m (m being an integer of 2 or more) as a lower-order bit in accordance with n-bit display data, a drive part includes a gray-scale voltage generating circuit which generates M pieces of gray-scale voltages where the gray scale number with respect to the gray-scale voltages is discontinuous, a decoder circuit which selects two neighboring gray-scale voltages out of M pieces of gray-scale voltages based on data of upper-order (n-m) bits in accordance with n-bit display data, and an output amplifying circuit which generates gray-scale voltages between two gray-scale voltages from two gray-scale voltages selected by the decoder circuit based on the data of lower-order m bits in accordance with n-bit display data and outputs the gray-scale voltages to the video lines.

6 Claims, 10 Drawing Sheets

DISPLAY DEVICE

BACKGROUND OF THE INVENTION

1. Field of the Invention

The present invention relates to a display device, and more particularly to a display device capable of performing a multi-gray scale display used in a personal computer, a work station and the like.

2. Description of the Related Art

An active matrix type liquid crystal display device which includes an active element (for example, a thin film transistor) for each pixel and performs the switching driving of the active elements has been popularly used as a display device of a notebook type personal computer or the like.

In this active matrix type liquid crystal display device, a video signal voltage (gray-scale voltage corresponding to display data: hereinafter referred to as "gray-scale voltage") is applied to pixel electrodes through the active elements, there is no crosstalk between respective pixels and hence, it is unnecessary to use a particular driving method for preventing the crosstalk different from a simple matrix type liquid crystal display device which requires such a particular driving method whereby it is possible to perform the multi-gray scale display.

As one of the active matrix type liquid crystal display devices, there has been known a TFT type liquid crystal display module which includes a TFT (Thin Film Transistor) type liquid crystal display panel (TFT-LCD), a drain driver which is arranged on an upper side of the liquid crystal display panel, a gate driver which is arranged on a side surface of the liquid crystal display panel, and interface portions (see JP-A-2001-34234 which constitutes a prior art literature relating to the present invention (hereinafter referred to as "patent literature").

This TFT type liquid crystal display module includes a gray-scale voltage generating circuit, a decoder circuit which selects one gray-scale voltage corresponding to display data out of a plurality of gray-scale voltages generated by the gray-scale voltage generating circuit, and an output amplifying circuit to which one gray-scale voltage selected by the decoder circuit is inputted.

SUMMARY OF THE INVENTION

With respect to recent active matrix type liquid crystal display devices adopting a TFT method, a demand for large-sizing of a liquid crystal display panel, a demand for higher resolution, a demand for higher image quality and a demand for lowering of power consumption have been attracting attentions.

Further, along with the maturing of a market of the liquid crystal display devices, it is a prerequisite to reduce a manufacturing cost of the liquid crystal display device and hence, there exists a demand for the downsizing of a chip area of a drain driver.

Still further, along with the popularization of liquid crystal display panels for monitoring as display devices having a large screen size which replaces cathode ray tubes, there also exists a demand for a display device of high resolution and multi-gray scales.

Conventionally, although 64 gray scales have been used in a liquid crystal display panel for a notebook type personal computer, 256 gray scales are indispensable in a liquid crystal display panel for monitoring. Recently, there exists a tendency that the number of gray scales will be increased to 1024 gray scales. Further, also with respect to the resolution of the liquid crystal display panel for monitoring, the level of resolution has been shifted from the XGA (extended video graphics array) specification to the SXGA (super XGA) specification or the UXGA (ultra XGA) specification.

Accordingly, the number of transistors which constitute a decoder circuit is increased. This leads to the increase of the size of a chip which constitutes a drain driver thus giving rise to a drawback that a manufacturing cost is pushed up.

That is, a conventional so-called tournament type decoder method requires the number of decoder circuits equal to the number of gray scales and hence, this becomes one of main factors which increase the size of the chip along with the realization of the multi-gray scales.

To overcome this drawback, in the above-mentioned patent literature, gray-scale voltages of two gray scales are generated in an output amplifying circuit.

However, for example, with respect to 1024 gray scales in which the display data is constituted of 10 bits, even when the gray-scale voltages of two gray scales are generated in an output amplifying circuit, the decoder circuits corresponding to 512 gray scale number are necessary and hence, this provision does not largely contribute to the suppression of the increase of the chip size.

The present invention has been made to overcome the above-mentioned drawbacks of the related art and it is an object of the present invention to provide a technique which can, in a display device, reduce the number of transistors in a decoder circuit thus realizing the suppression of the increase of the chip size.

The above-mentioned and other objects and novel features of the present invention will become apparent from the description of the present invention and attached drawings.

To achieve the above-mentioned object, the present invention is directed to a display device which includes a display part having a plurality of pixels, a plurality of video lines which apply gray-scale voltages to the plurality of pixels, and a drive part which supplies gray-scale voltages corresponding to display data to the plurality of video lines, wherein a gray-scale voltage generating circuit arranged in the inside of the drive part, assuming m (m being an integer of 2 or more) as a lower-order bit in accordance with n-bit display data, generates M pieces of gray-scale voltages where the gray scale number with respect to the gray-scale voltages is discontinuous, a decoder circuit selects two neighboring gray-scale voltages out of M pieces of gray-scale voltages based on data of upper-order (n-m) bits in accordance with n-bit display data, and an output amplifying circuit generates gray-scale voltages between two gray-scale voltages from two gray-scale voltages selected by the decoder circuit based on the data of lower-order m bits in accordance with n-bit display data and supplies the gray-scale voltages to the video lines.

To explain advantageous effects obtained by the representative invention out of the inventions disclosed in this specification, they are as follows.

According to the display device of the present invention, it is possible to suppress the increase of the chip size by reducing the number of transistors of a decoder circuit compared to a conventional display device.

DETAILED DESCRIPTION OF THE INVENTION

Hereinafter, embodiments to which the present invention is applied are explained in detail in conjunction with drawings.

Here, in all drawings for explaining the embodiments, parts having identical functions are indicated by same symbols and their repeated explanation is omitted.

<Basic Constitution of a Liquid Crystal Display Device to Which the Present Invention is Applied>

Figure 1:
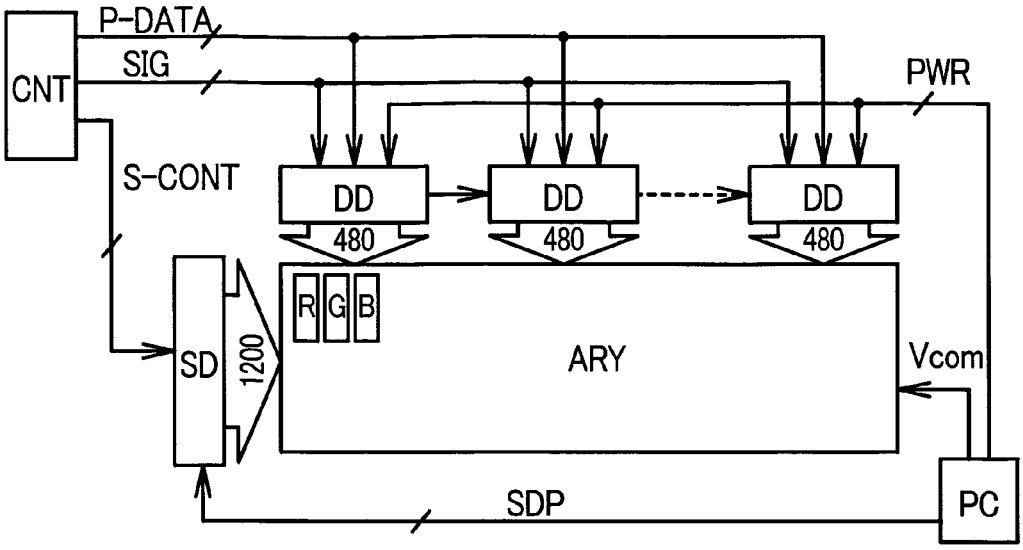
FIG. 1 is a block diagram for explaining the schematic constitution of a liquid crystal display device to which the present invention is applied.

FIG. 1 is a block diagram for explaining the schematic constitution of a liquid crystal display device to which the present invention is applied.

In FIG. 1, ARY indicates a thin-film-transistor-type active matrix type liquid crystal display panel (TFT-LCD), DD indicates drain drivers, and SD indicates a gate driver.

In the liquid crystal display panel ARY, each pixel of respective pixels of three colors consisting of red (R), green (G) and blue(B) constitutes one pixel. For example, the liquid crystal display panel ARY is constituted of 1600×1200 pixels.

A display control device CNT controls the drain drivers DD and the gate driver SD based on three color display data (video signals) of red(R), green(G) and blue(B) which are outputted from a host (a host computer) such as a personal computer, respective display control signals such as a clock signal, a display timing signal, a horizontal synchronizing signal, a vertical synchronizing signal and display data (R·G·B).

The display control device CNT, when the display timing signal is inputted, determines this inputting as a display start position and outputs a start pulse (EIO: a display data fetching start signal) to the first drain drivers DD through a signal line and, further, outputs the received display data to the drain drivers DD through a bus line.

At this point of time, the display control device CNT outputs a display data latch clock (CL2) which constitutes a display control signal for latching the display data (hereinafter simply referred to as "clock (CL2)") to data latch circuits of the respective drain drivers DD through signal lines.

The display data from the host side is 8 bits and two pixel units, that is, two sets of data each of which is constituted of respective data of red(R), green(G) and blue(B) are transmitted for every unit time.

Further, in response to the start pulse inputted to the first drain driver DD, a latch operation of the data latch circuit in the first drain driver DD is controlled.

When the latch operation of the data latch circuit in the first drain driver DD is finished, a start pulse is inputted to the second drain driver DD from the first drain driver DD and a latch operation of the data latch circuit in the second drain driver DD is controlled.

Thereafter, in the same manner, latch operations of data latch circuits in the respective drain drivers DD are controlled so as to prevent the erroneous display data from being written in the data latch circuits.

The display control device CNT, when the inputting of the display timing signal is finished or a given time elapses after the display timing signal is inputted, assumes that the display data for one horizontal amount is finished and outputs an output timing control clock (CL1) which is a display control signal for outputting the display data stored in the data latch circuit of each drain driver DD (hereinafter simply referred to as "clock (CL1)") to drain lines of the liquid crystal display panel ARY to each drain driver DD through the signal line.

Further, the display control device CNT, when the first display timing signal is inputted after inputting the vertical synchronizing signal, determines this inputting as the first display line and outputs a frame start instruction signal (FRM) to the gate driver SD through the signal line.

Further, the display control device CNT, based on the horizontal synchronizing signal, outputs the clock (CL3) which is a shift clock of one horizontal scanning time cycle to the gate driver SD through a signal line 141 for every one horizontal scanning time such that a positive bias voltage is sequentially applied to respective gate lines of the liquid crystal display panel ARY.

Accordingly, a plurality of thin film transistors (TFT) which are connected with the respective gate lines of the liquid crystal display panel ARY become conductive for one horizontal scanning time.

Due to the above-mentioned operations, an image is displayed on the liquid crystal display panel ARY.

Here, in FIG. 1, SIG indicates signal lines through which the respective control signals including the above-mentioned EIO, CL1, CL2 and alternating signals M described later are transmitted, S-CONT indicates signal lines through which respective control signals including the above-mentioned CL3, FLM are transmitted. Further, P-DATA indicates a bus line through which the above-mentioned display data is transmitted.

Further, in FIG. 1, PC indicates a liquid crystal drive power source circuit. The liquid crystal drive power source circuit PC supplies gray-scale reference voltages PWR consisting of V0 to V11 to the drain drivers DD, supplies scanning driver voltages (SDP) consisting of VGON, VGOFF to the gate driver SD, and supplies a counter electrode voltage of Vcom to counter electrodes in the inside of the liquid crystal display panel ARY.

Generally, with respect to the liquid crystal layer, when the same voltage (DC voltage) is applied for a long time, the inclination of the liquid crystal layer is fixed and this eventually induces an image retention phenomenon thus shortening a lifetime of the liquid crystal layer.

To prevent such a phenomenon, in the liquid crystal display module, the voltage applied to the liquid crystal layer is alternated for every fixed time. That is, using the voltage applied to the common electrode as the reference, the voltage applied to the pixel electrodes is changed to the positive-voltage side and the negative-voltage side for every fixed time.

As a method for applying the AC voltage to the liquid crystal layer, two methods, that is, a common symmetry method and a common inversion method are known.

The common inversion method is a method which alternately inverts the voltage applied to the common electrode and the voltage applied to the pixel electrodes to the positive voltage and the negative voltage alternately.

The common symmetry method is a method in which the voltage applied to the common electrode is fixed and the voltage applied to the pixel electrodes is alternately inverted to the positive voltage and the negative voltage using the voltage applied to the common electrode as the reference.

In the common symmetry method, amplitude of the voltage applied to the pixel electrodes becomes twice as high as amplitude of the voltage applied to the pixel in the common inversion method. Accordingly, although the common inversion method has a drawback that the method cannot use a low dielectric-strength driver, a dot inversion method or an N line inversion method which is excellent in the low power consumption and display quality is available.

The liquid crystal display module shown in FIG. 1, as a driving method thereof, adopts the above-mentioned dot inversion method.

Figure 2:
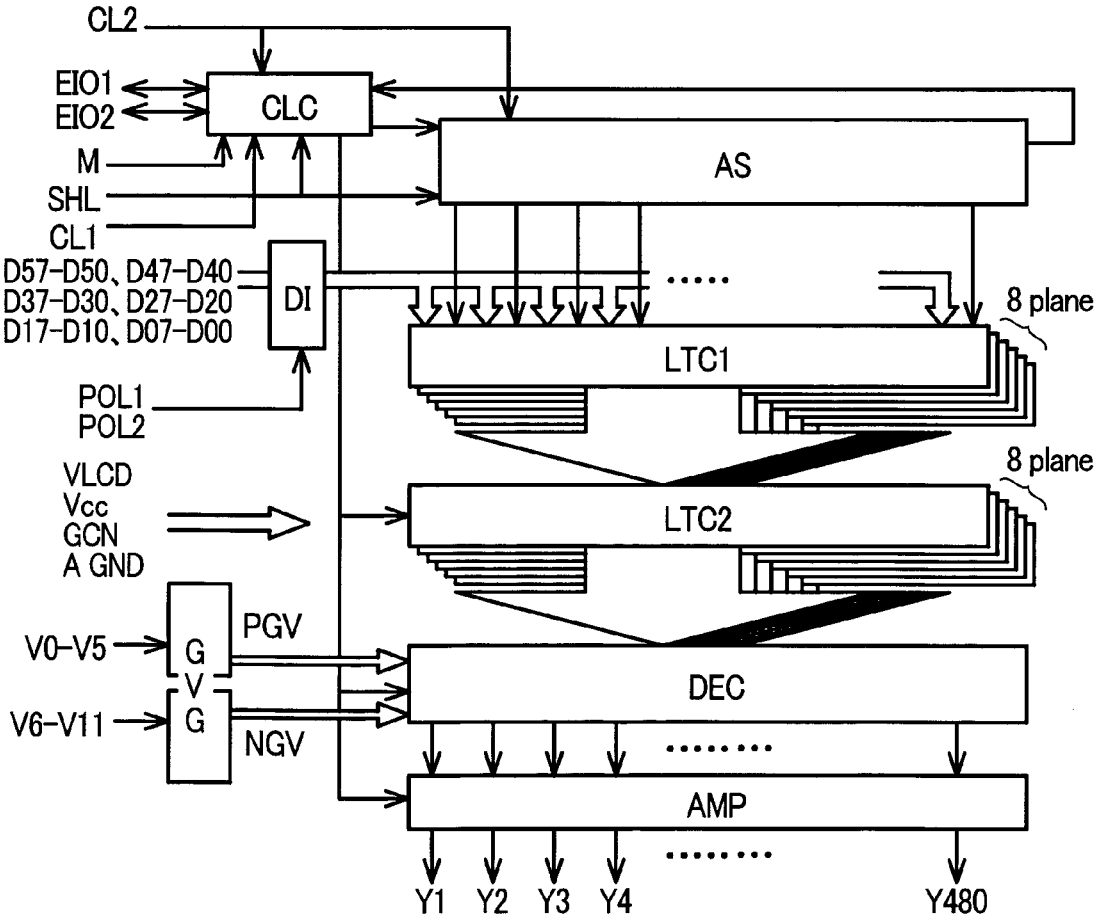
FIG. 2 is a block diagram showing the schematic constitution of one example of a drain driver DD shown in FIG. 1.

FIG. 2 is a block diagram showing the schematic constitution of one example of the drain driver DD shown in FIG. 1.

Here, the explanation is made with respect to a drain driver which exhibits 256 gray scales in accordance with 8-bit display data and has 480 outputs as an example.

The drain driver DD is constituted of one semiconductor integrated circuit (LSI).

In the drawing, CLC indicates a clock control circuit. A positive-polarity gray-scale voltage generating circuit PGV generates 256 gray-scale voltages of positive polarity based on the gray scale reference voltages of six values (V0 to V5) of positive polarities inputted from the liquid crystal drive power source circuit PC and outputs these gray-scale voltages to the decoder circuit DEC.

A negative-polarity gray-scale voltage generating circuit NGV generates 256 gray-scale voltages of negative polarity based on the gray scale reference voltages of six values (V6 to V11) of negative polarity inputted from the liquid crystal drive power source circuit PC and outputs these gray-scale voltages to the decoder circuit DEC.

Further, a latch address selector AS of the drain driver DD, in response to a clock (CL2) which is inputted from the display control device CNT, generates a data fetching signal of a latch circuit 1 (LTC1) and outputs the data fetching signal to the latch circuit 1 (LTC1).

The latch circuit 1 (LTC1), based on the data fetching signal outputted from the latch address selector AS, latches the display data of 8 bits for each color corresponding to the number of outputting signals in synchronism with the clock (CL2) inputted from the display control device CNT.

The display data (D57 to D50, D47 to D40, D37 to D30, D27 to D20, D17 to D10, D07 to D00) is inputted to and latched by a latch circuit 14 through a data inversion circuit 3.

A latch circuit 2 (LTC2), in response to the clock (CL1) inputted from the display control device CNT, latches the display data in the inside of the latch circuit 1 (LTC1).

The display data fetched into the latch circuit 2 (LTC2) is inputted to the decoder circuit DEC.

The decoder circuit DEC, based on the gray-scale voltages of 256 gray scales having positive polarity or the gray-scale voltages of 256 gray scales having negative polarity, selects one gray-scale voltage (one gray-scale voltage out of 256 gray scales) corresponding to the display data and inputs the gray-scale voltage into an output amplifying circuit AMP.

The output amplifying circuit AMP performs the amplifying of a current of the inputted gray-scale voltage and outputs the gray-scale voltage to drain lines (Y1 to Y480) of the display panel.

The latch circuit 14 and the latch circuit 25 are respectively constituted of 8 bit (256 gray scales)×480 pieces.

Figure 3:
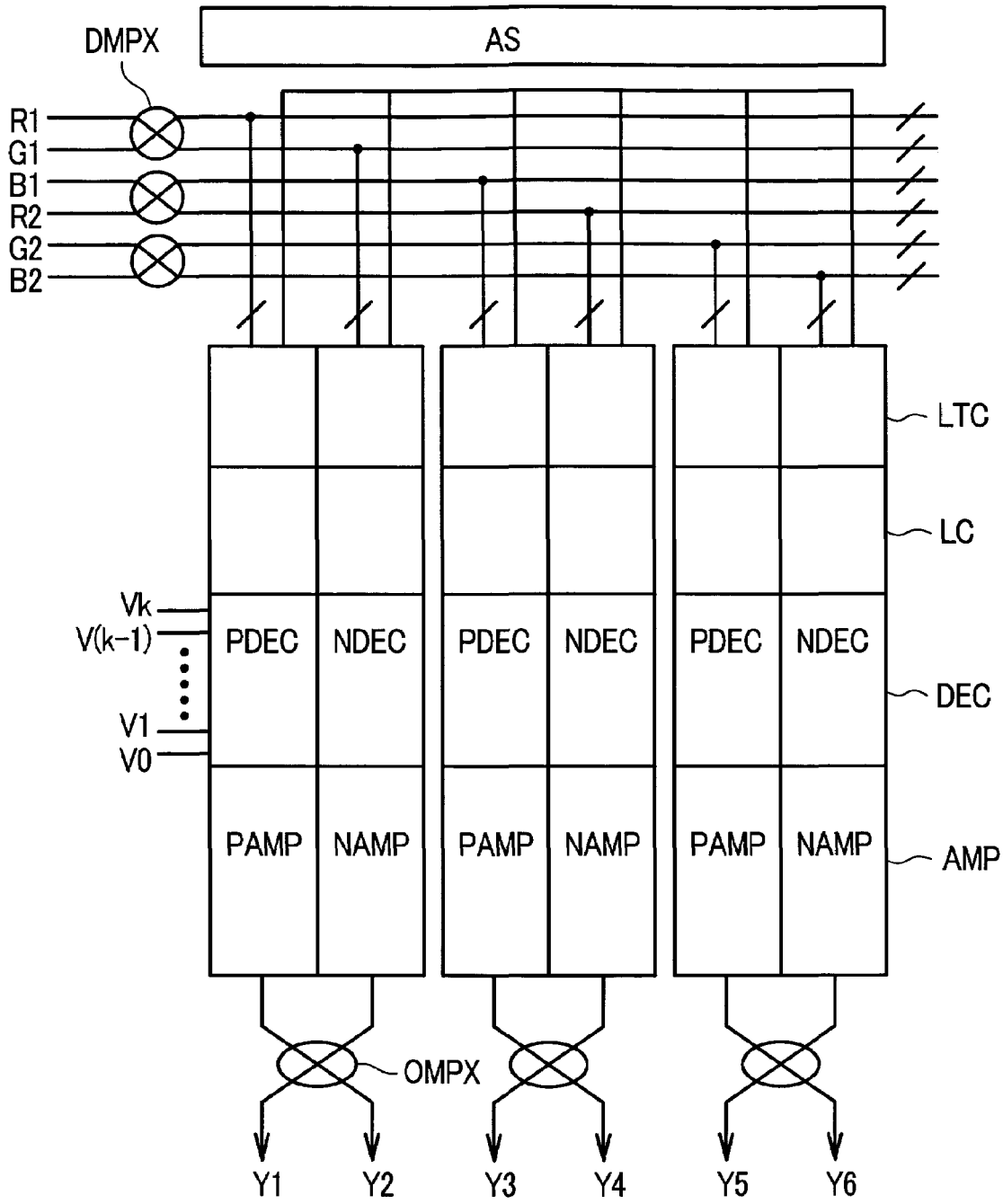
FIG. 3 is a block diagram showing one example of an internal circuit of the drain driver DD shown in FIG. 2.
Figure 4:
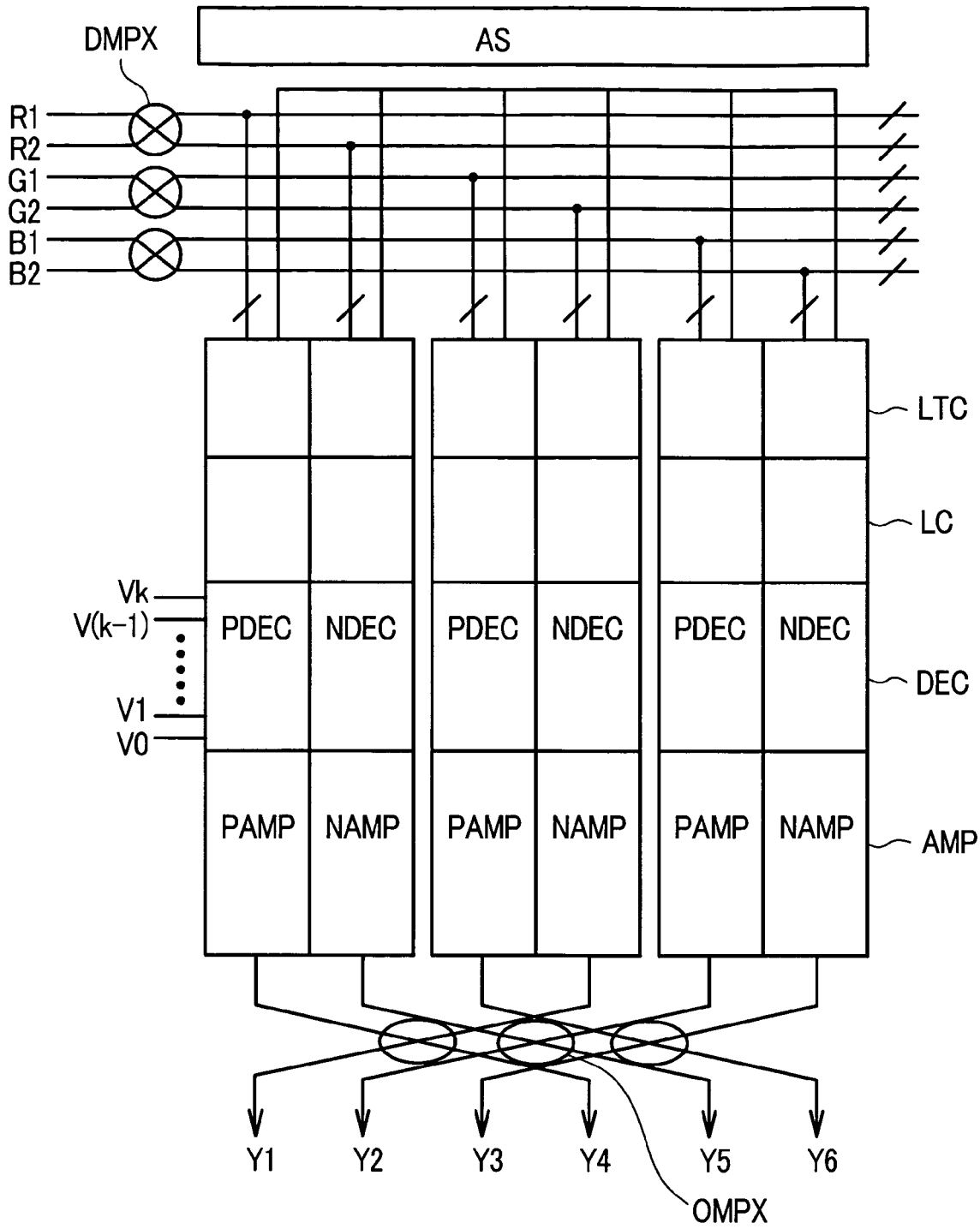
FIG. 4 is a block diagram showing another example of an internal circuit of the drain driver DD shown in FIG. 2.

FIG. 3 and FIG. 4 are block diagrams showing one example of an internal circuit of the drain driver DD shown in FIG. 2.

In the drawing, LS indicates a level shift circuit, DMPX indicates a display data multiplexer, and OMPX indicates an output multiplexer. The display data multiplexer DMPX and the output multiplexer OMPX are controlled based on the AC signal M.

The AC signal (M) is a logic signal which controls the polarity of the video signal voltage applied to the respective pixel electrodes of the respective pixels of the liquid crystal display panel ARY and the logics of the logic signal are inverted for every line and for every frame. Further, the latch circuit LTC implies the latch circuit 1 (LTC1) and the latch circuit 2 (LTC2) shown in FIG. 2.

Further, Y1, Y2, Y3, Y4, Y5, Y6 respectively indicate the first drain line, the second drain line, the third drain line, the fourth drain line, the fifth drain line, and the sixth drain line.

In the drain driver DD shown in FIG. 3, the display data to be inputted to the latch circuit LTC (to be more specific, the latch circuit 1 shown in FIG. 2) is changed over by the display data multiplexer DMPX and the display data for each color is inputted to the neighboring latch circuit LTC.

The decoder circuit DEC is constituted of a high-voltage decoder circuit PDEC which selects the gray-scale voltage of positive polarity corresponding to the display data outputted from the latch circuit LTC (to be more specific, the latch circuit 2 shown in FIG. 2) out of the gray-scale voltages of 256 gray scales having positive polarity inputted from the positive-polarity gray-scale voltage generating circuit PGV, and a low-voltage decoder circuit NDEC which selects the gray-scale voltage of negative polarity corresponding to the display data outputted from the latch circuit LTC out of the gray-scale voltages of 256 gray scales having negative polarity inputted from the negative-polarity gray-scale voltage generating circuit NGV.

The high-voltage decoder circuit PDEC and the low-voltage decoder circuit NDEC are provided for every neighboring latch circuits LTC.

The output amplifying circuit AMP is constituted of a high-voltage amplifying circuit PAMP and a low-voltage amplifying circuit NAMP.

Upon receiving the inputting of the gray-scale voltage of positive polarity which is generated by the high-voltage decoder circuit PDEC, the high-voltage amplifying circuit PAMP outputs the gray-scale voltage of positive polarity.

Upon receiving the inputting of the gray-scale voltage of negative polarity which is generated by the low-voltage decoder circuit NDEC, the low-voltage amplifying circuit NAMP outputs the gray-scale voltage of negative polarity.

In the dot inversion method, the gray-scale voltages of the neighboring drains assume the polarities opposite to each other and the high-voltage amplifying circuit PAMP and the low-voltage amplifying circuit NAMP are arranged in order of the high-voltage amplifying circuit PAMP→the low-voltage amplifying circuit NAMP→the high-voltage amplifying circuit PAMP→the low-voltage amplifying circuit NAMP. Accordingly, by changing over the display data to be inputted to the latch circuit LTC by the display data multiplexer DMPX, by inputting the display data for respective colors to the neighboring latch circuits LTC, and by changing over the output voltage outputted from the high-voltage amplifying circuit PAMP and the low-voltage amplifying circuit NAMP using the output multiplexer OMPX in conformity with the inputting of the display data, and by outputting the output voltage to the neighboring drain lines, for example, the first drain line Y1 and the second drain line Y2, it is possible to output the gray-scale voltages of positive polarity and the negative polarity to the respective drain lines.

Figure 5:
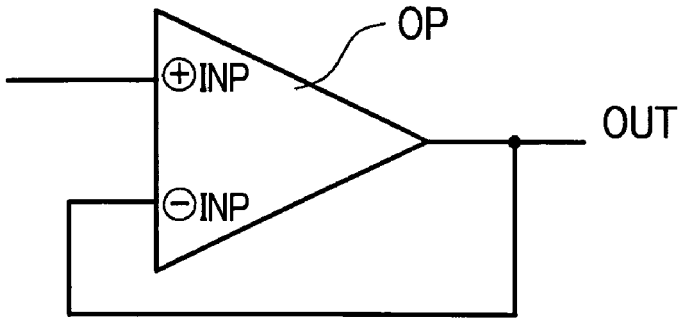
FIG. 5 is a circuit diagram showing the circuit constitution of a high-voltage amplifying circuit PAMP and a low-voltage amplifying circuit NAMP shown in FIG. 3 and FIG. 4.

Here, as the high-voltage amplifying circuit PAMP and the low-voltage amplifying circuit NAMP shown in FIG. 3 and FIG. 4 are formed of a voltage follower circuit shown in FIG. 5, for example, wherein an inverting input terminal (−) and an output terminal of the operational amplifier OP are directly connected with each other and a non-inverting input terminal (+) is used as an input terminal.

Figure 6:
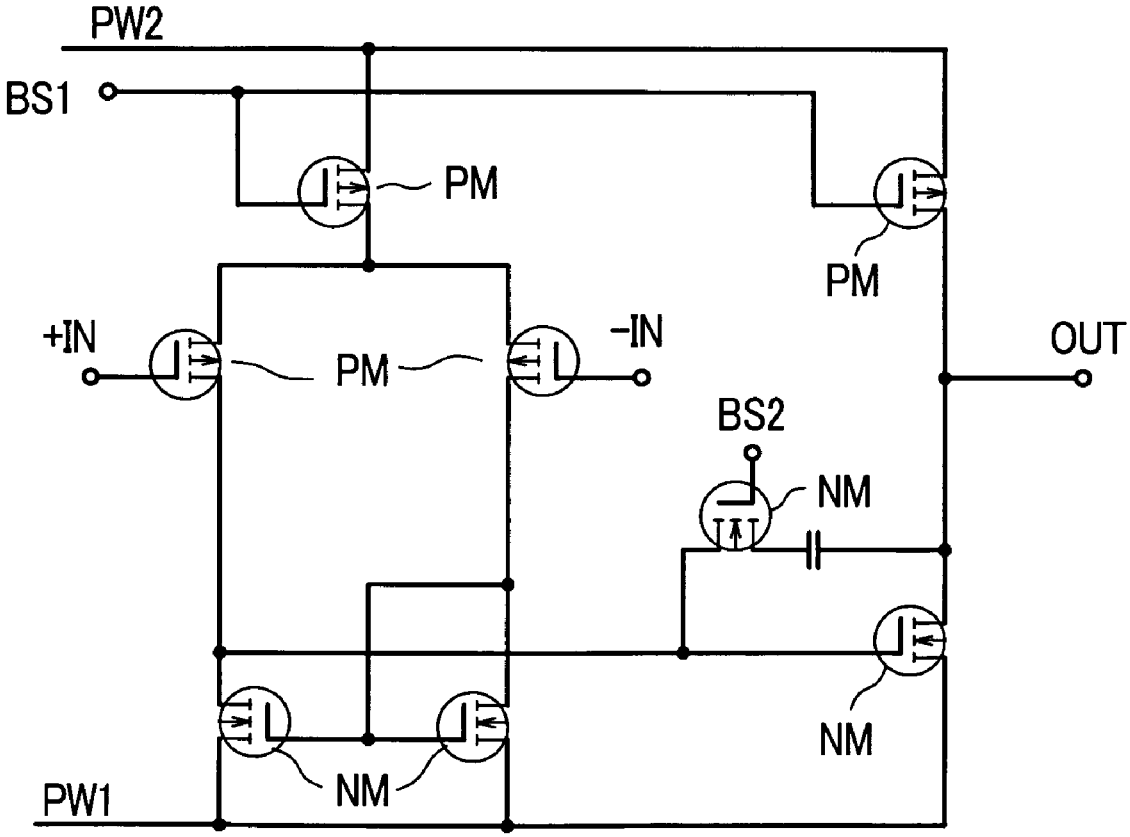
FIG. 6 is a circuit diagram showing the circuit constitution of an operational amplifier OP used in the low-voltage amplifying circuit NAMP.
Figure 7:
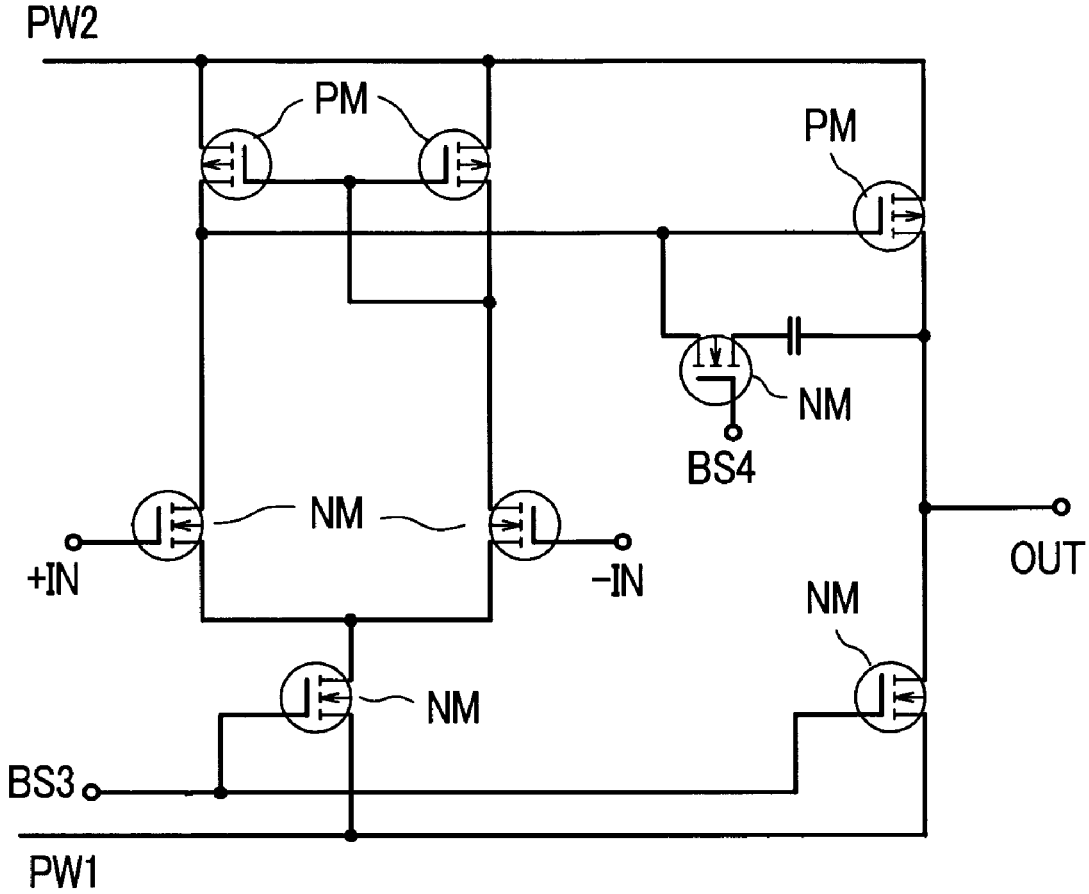
FIG. 7 is a circuit diagram showing the circuit constitution of an operational amplifier OP used in the high-voltage amplifying circuit PAMP.

Further, the operational amplifier OP used in the low-voltage amplifying circuit NAMP is formed of a differential amplifying circuit shown in FIG. 6, for example, and the operational amplifier OP used in the high-voltage amplifying circuit PAMP is formed of a differential amplifying circuit shown in FIG. 7.

Here, in FIG. 6 and FIG. 7, PM indicates a P-type MOS transistor (hereinafter simply referred to as "PMOS"), NM indicates a N-type MOS transistor (hereinafter simply referred to as "NMOS"), PW1, PW2 indicate power source voltages, and BS1, BS2, BS3, BS4 indicate bias power sources.

The drain driver DD shown in FIG. 4 differs from the drain driver DD shown in FIG. 3 with respect to points that the neighboring display data of respective colors are changed over by the display data multiplexer DPMX and are inputted to the latch circuit LTC, and output voltages are outputted to the drain lines to which the gray-scale voltages for respective colors are outputted, for example, the first drain line Y1 and the fourth drain line Y4 by the output multiplexer OMPX.

In this manner, in the drain drivers DD shown in FIG. 3 and FIG. 4, by making use of the outputting of the negative polarity side (low voltage side) and the positive polarity side (high voltage side) alternately between the neighboring output terminals, by providing the circuits of negative polarity and the circuits of positive polarity in numbers which respectively do not correspond to the total numbers of the output terminals but respectively correspond to ½ of the total numbers of the output terminals, it is possible to reduce the chip size.

<Characteristic Constitution of Liquid Crystal Display Module of this Embodiment>

The liquid crystal display module of this embodiment differs from the drain driver DD which is explained previously in conjunction with FIG. 2 with respect to the constitution of the decoder circuit DEC and the output amplifying circuit AMP in the inside of the drain driver DD.

Figure 8:
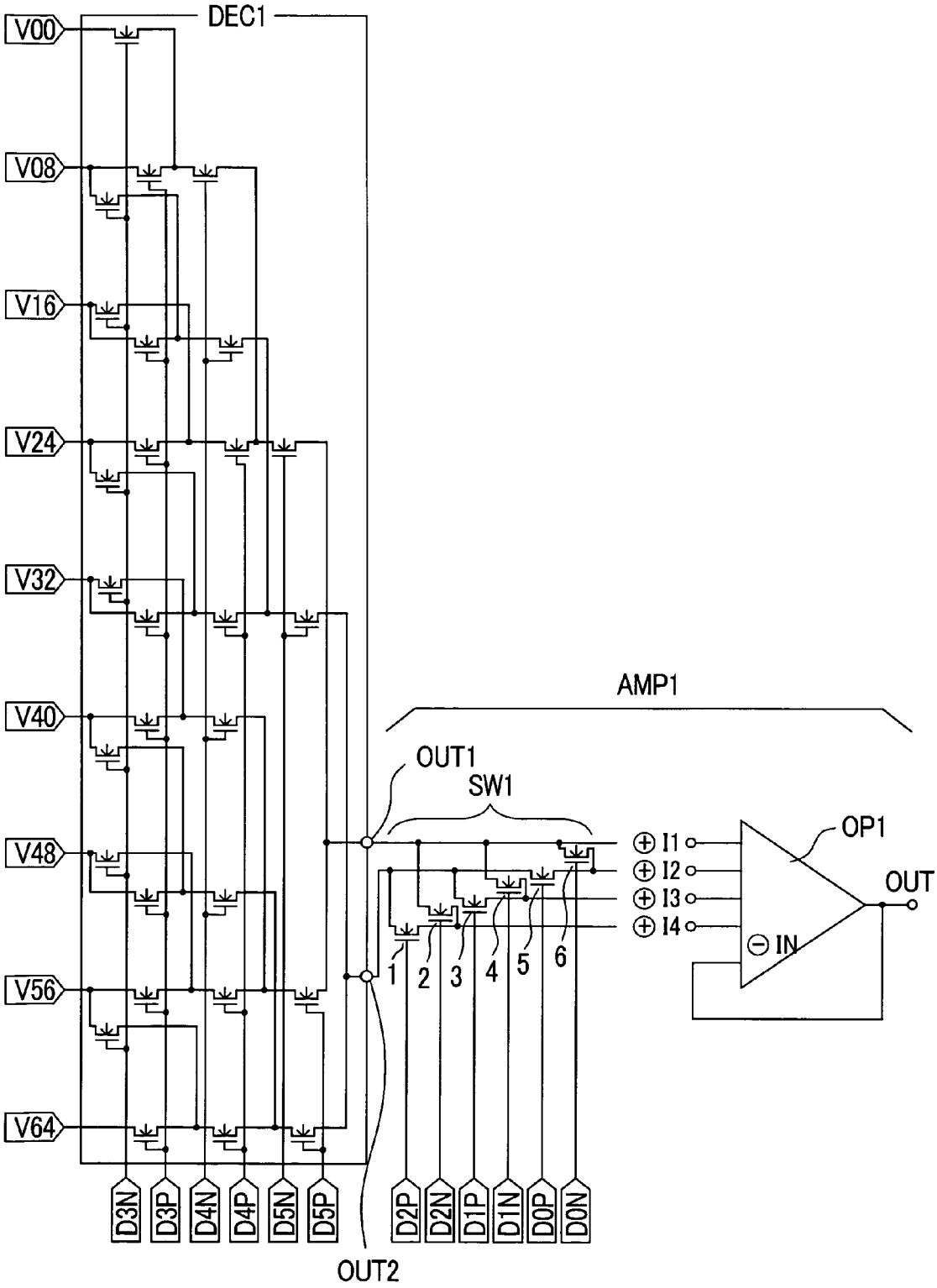
FIG. 8 is view showing the circuit constitution of a decoder circuit and an output amplifying circuit of a drain driver DD of a liquid crystal display module of an embodiment of the present invention.

FIG. 8 is a view showing the circuit constitution of the decoder circuit and the output amplifying circuit of the drain driver DD of the liquid crystal display module of the embodiment of the present invention.

Here, since the circuit constitution for 256 gray scales has the large circuit scale and cannot be accommodated in one drawing, the explanation is made with respect to the circuit constitution for 64 gray scales.

Further, the decoder circuit DEC1 and the output amplifying circuit AMP1 shown in FIG. 8 are a low-voltage decoder circuit NDEC and a low-voltage amplifying circuit NAMP which output the gray scale voltages of negative polarity.

As shown in FIG. 8, the decoder circuit DEC1 is constituted of NMOS and these NMOS are turned on and off using the upper-order 3 bits in the display data of 6 bits.

Here, in FIG. 8, D0 to D5 indicate the display data of 6 bits in which D0 constitutes a lowermost-order bit and D5 constitutes an uppermost-order bit. DnP indicates a normal data value and DnN indicates a data value which is obtained by inverting the DnP.

In this embodiment, the negative-polarity gray-scale voltage generating circuit NGV does not generate all gray-scale voltages of 64 gray scales but generates gray-scale voltages of 9 gray scales (V00 to V64) which are selected every 8 other gray scales.

The gray-scale voltages of 9 gray scales (V00 to V64) which are selected every 8 other gray scales are inputted into the decoder circuit DEC1 shown in FIG. 8, wherein the decoder circuit DEC1 selects two neighboring gray-scale voltages and outputs these gray-scale voltages to the output terminal 1 (OUT1) and the output terminal 2 (OUT2).

The output amplifying circuit AMP1 is constituted of the operational amplifier OP1 having four non-inverting input terminals (I1 to I4) and the switch part SW1 which is arranged in a preceding stage of four non-inverting input terminals (I1 to I4).

The switch part SW1 includes an NMOS (1), an NMOS (2), an NMOS (3), an NMOS (4), an NMOS (5) and an NMOS (6).

The NMOS(1) is turned on or off based on a data value of the D2P and connects the output terminal 2 (OUT2) of the decoder circuit DEC1 and the non-inverting input terminal I4 of the operational amplifier OP1 in an ON state.

In the same manner, the NMOS (2) is turned on or off based on a data value of the D2N and connects the output terminal 1 (OUT1) and the non-inverting input terminal I4 in an ON state.

The NMOS(3) is turned on or off based on a data value of the D1P and connects the output terminal 2 (OUT2) and the non-inverting input terminal I3 in an ON state.

The NMOS (4) is turned on or off based on a data value of the DiN and connects the output terminal 1 (OUT1) and the non-inverting input terminal I3 in an ON state.

The NMOS (5) is turned on or off based on a data value of the DOP and connects the output terminal 2 (OUT2) and the non-inverting input terminal I2 in an ON state.

The NMOS (6) is turned on or off based on a data value of the DON and connects the output terminal 1 (OUT1) and the non-inverting input terminal I2 in an ON state.

The non-inverting input terminal I1 of the operational amplifier OP1 is connected with the output terminal 1 (OUT1) of the decoder circuit DEC1.

Figure 9:
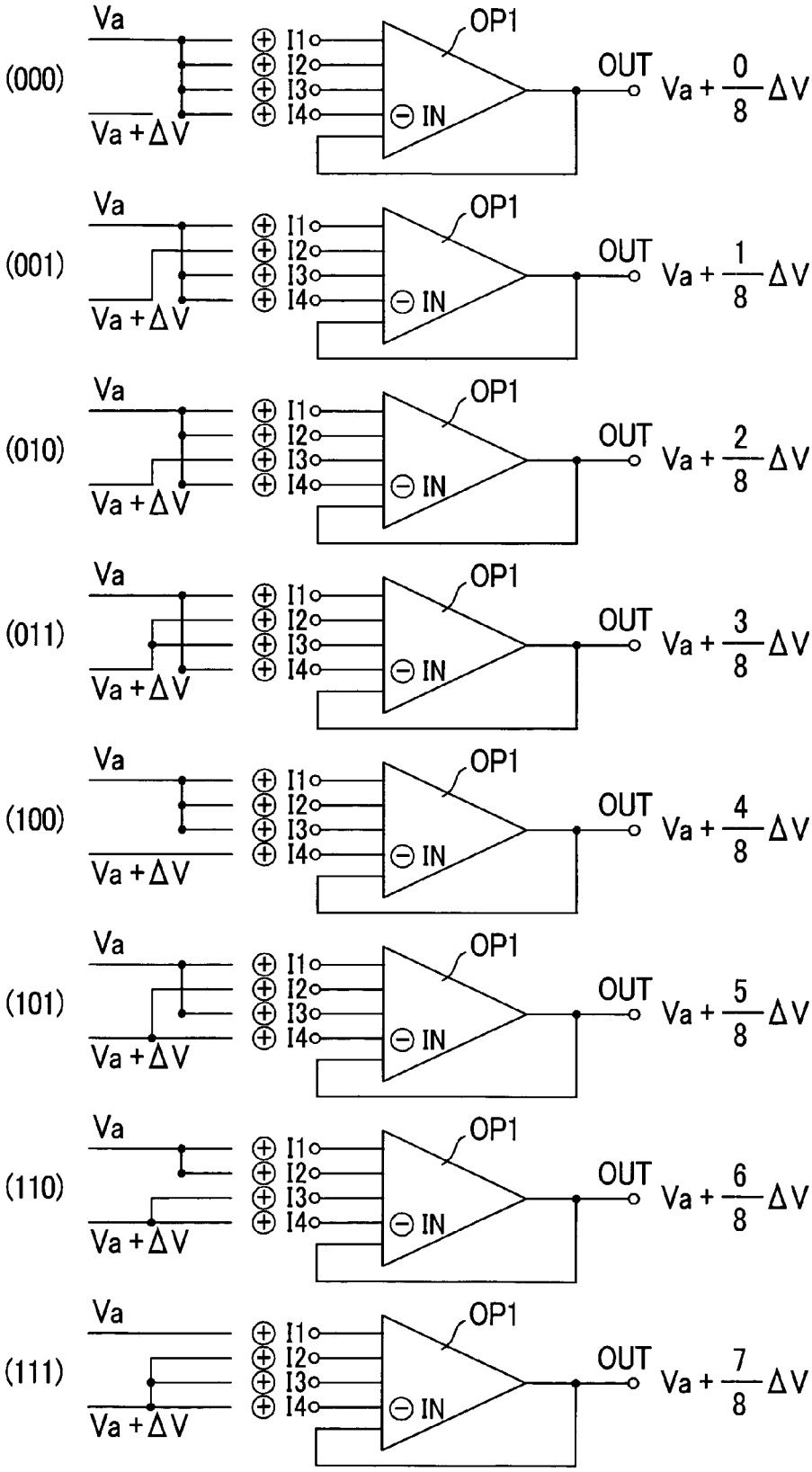
FIG. 9 is a view showing gray-scale voltages which are inputted to an operational amplifier OP1 shown in FIG. 8 and gray-scale voltages which are outputted from the operational amplifier OP1.

Assuming the gray-scale voltage outputted from the output terminal 1 (OUT1) of the decoder circuit DEC1 as Va and the gray-scale voltage outputted from the output terminal 2 (OUT2) of the decoder circuit DEC1 as Vb (Vb=Va+ΔV), in this embodiment, based on the data value of lower-order 3 bits of the display data, the gray-scale voltages outputted from the output terminal 1 (OUT1) and the output terminal 2 (OUT2) of the decoder circuit DEC1 are inputted to four non-inverting input terminals (I1 to I4) of the operational amplifier OP1 in accordance with combinations shown in FIG. 9.

The operational amplifier OP1 generates eight gray-scale voltages as shown in FIG. 9 in accordance with the combinations of the gray-scale voltages outputted from the output terminal 1 (OUT1) and the output terminal 2 (OUT2) of the decoder circuit DEC1.

The circuit constitution of the operational amplifier OP1 of this embodiment is explained hereinafter.

Figure 10:
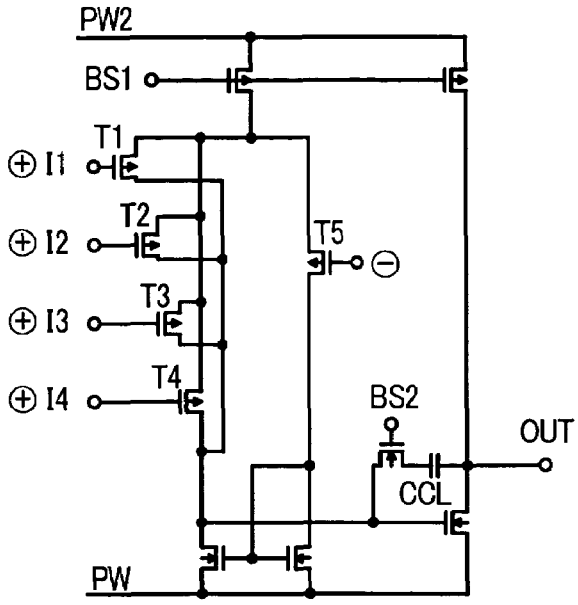
FIG. 10 is a circuit diagram showing the circuit constitution of the operational amplifier OP1 of the embodiment of the present invention.

FIG. 10 is a circuit diagram showing the constitution of the operational amplifier OP1 of this embodiment.

The operational amplifier OP1 shown in FIG. 10 differs from the conventional operational amplifier OP shown in FIG. 6 with respect to a point that the transistors which constitute the differential pair are four PMOS (T1, T2, T3, T4) and one PMOS (T5).

Here, the gate electrode of the PMOS (T1) is connected with the non-inverting input terminal I1, the gate electrode of PMOS (T2) is connected with the non-inverting input terminal I2, the gate electrode of the PMOS (T3) is connected with the non-inverting input terminal I3, and the gate electrode of PMOS (T4) is connected with the non-inverting input terminal I4.

Further, assuming a gate width of the gate electrode of the PMOS (T1) as W, a gate width of the gate electrode of the PMOS (T2) becomes W($=2^0\times$W), a gate width of the gate electrode of the PMOS (T3) becomes 2W($=2^1\times$W), and a gate width of the gate electrode of the PMOS (T4) becomes 4W($=2^2\times$W). A gate width of the gate electrode of the PMOS (T5) which constitutes the differential pair with four PMOS (T1, T2, T3, T4) becomes 8W($=2^3\times$W).

Here, in place of applying the weighting to the gate width of the gate electrode of the PMOS, a given number of PMOS having the gate width of W may be connected in parallel.

Figure 11:
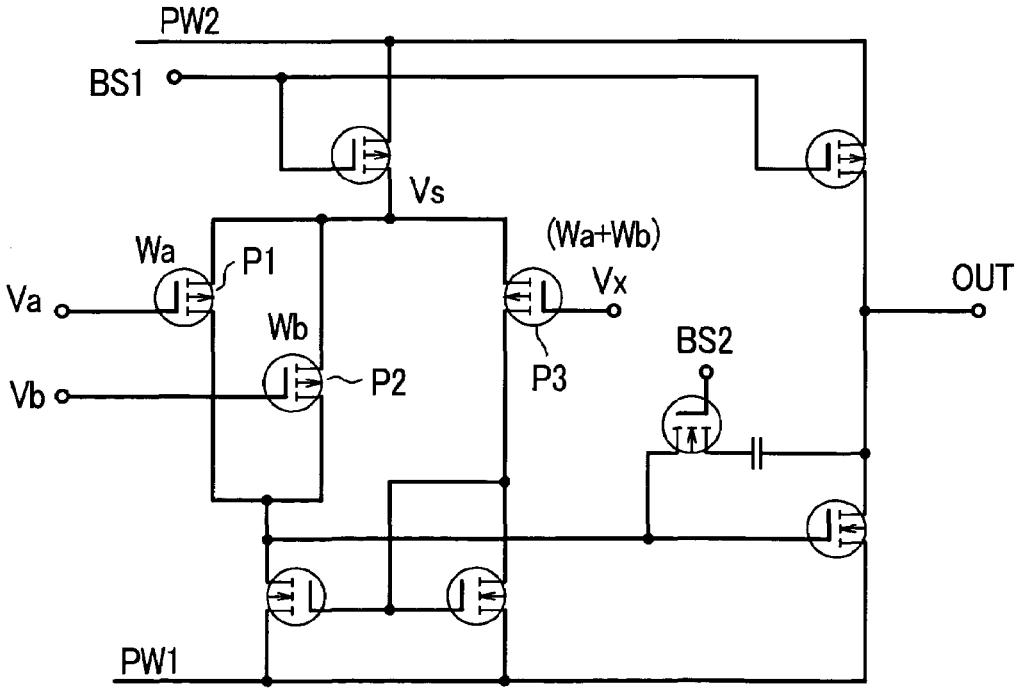
FIG. 11 is a circuit diagram for explaining an operation of the operational amplifier shown in FIG. 10.

The operational amplifier shown in FIG. 10 is equivalent to a circuit shown in FIG. 11.

Here, assume a gate width of the gate electrode of the PMOS (P1) shown in FIG. 11 as Wa and a gate width of the gate electrode of the PMOS (P2) shown in FIG. 11 as Wb. Accordingly, a gate width of the gate electrode of the PMOS (P3) which constitutes the differential pair with the PMOS (P1, P2) becomes (Wa+Wb).

In general, the voltage difference of the gray-scale voltages outputted from the output terminal 1 (OUT1) and the output terminal 2 (OUT2) of the decoder circuit DEC1 shown in FIG. 8 is 0.5V or less and hence, a drain current (Id) of the PMOS can be treated as a current which is proportional to the voltage obtained by subtracting a threshold value voltage Vth from a gate-source voltage.

Accordingly, a drain current (Ia) of the PMOS (P1), a drain current (Ib) of the PMOS (P2) and a drain current (Ix) of the PMOS (P3) are expressed by a following formula (1).

$$Ia=\alpha Wa(Vs-Va-Vth)\ Ib=\alpha Wb(Vs-Vb-Vth)\ Ix=\alpha(Wa+Wb)(Vs-Vx-Vth) \quad (1)$$

Here, $\alpha$ is a constant.

In the circuit shown in FIG. 11, Ia+Ib=Ix and hence, a following formula (2) is established.

$$Ia+Ib=Ix\ Wa(Vs-Va-Vth)+Wb(Vs-Vb-Vth)=(Wa+Wb)(Vs-Vx-Vth)\ (Wa+Wb)Vs+WaVa+WbVb-(Wa+Wb)Vth=(Wa+Wb)Vs+(Wa+Wb)Vx-(Wa+Wb)Vth\ WaVa+WbVb=(Wa+Wb)Vx\ Vx=(WaVa+WbVb)/(Wa+Wb) \quad (2)$$

Here, assuming Vb=Va+Δv, $$Vx=\{WaVa+Wb(Va+\Delta v)\}/(Wa+Wb)$$
$$=\{(Wa+Wb)Va+Wb\Delta v\}/(Wa+Wb)$$
$$=Va+Wb\Delta v/(Wa+Wb)$$

Now, a case in which Wa+Wb=8W (W is the gate width of the gate electrode of PMOS (T1) shown in FIG. 10) is considered.

(1) When Wa=8W, Wb=0, Vx=Va
(2) When Wa=7W, Wb=1W, Vx=Va+Δv/8
(3) When Wa=6W, Wb=2W, Vx=Va+2Δv/8
(4) When Wa=5W, Wb=3W, Vx=Va+3Δv/8
(5) When Wa=4W, Wb=4W, Vx=Va+4Δv/8
(6) When Wa=3W, Wb=5W, Vx=Va+5Δv/8
(7) When Wa=2W, Wb=6W, Vx=Va+6Δv/8
(8) When Wa=W, Wb=7W, Vx=Va+7Δv/8

In this manner, the operational amplifier OP1 shown in FIG. 10 can generate eight gray-scale voltages in accordance with the combinations of the gray-scale voltages outputted from the output terminal 1 (OUT1) and the output terminal 2 (OUT2) of the decoder circuit DEC1.

As has been explained heretofore, in this embodiment, in the decoder circuit DC1, from the gray-scale voltages (V00 to V64) of nine gray scales chosen for every eight other gray scales, two neighboring gray-scale voltages are selected and the gray-scale voltages of eight gray scales between two neighboring gray-scale voltages are generated in the output amplifying circuit AMP1. Accordingly, in this embodiment, the number of transistors of the decoder circuit DC1 can be largely suppressed.

Figure 13:
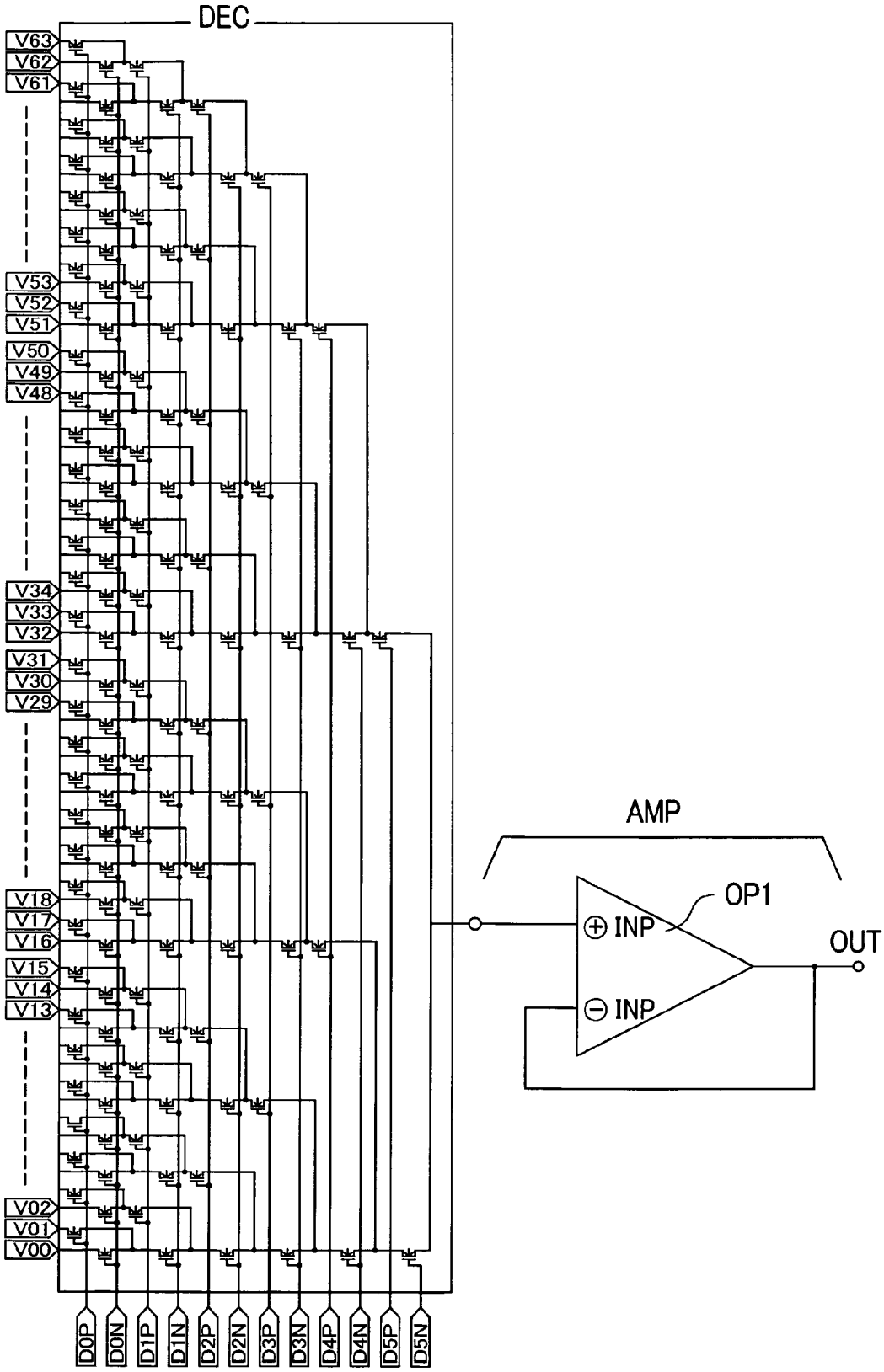
FIG. 13 is a circuit diagram showing a conventional decoder circuit adopting a tournament method.

For a comparison purpose, FIG. 13 shows a conventional decoder circuit of a tournament method which generates one gray-scale voltage from gray-scale voltages of 64 gray scales.

As can be understood from the decoder circuit shown in FIG. 13, the decoder circuit DEC1 of this embodiment can reduce the number of transistors by approximately 70% compared to the decoder circuit shown in FIG. 13.

Further, in this embodiment, by applying the weighting to the gate widths of the gate electrodes of the output amplifying circuit AMP1, it is possible to reduce the number of transistors of the output amplifying circuit AMP1.

Accordingly, in this embodiment, it is possible to largely reduce the chip size of the semiconductor chip which constitutes the drain driver DD and hence, it is possible to realize the multi-gray scales without inducing the increase of the chip size.

Here, in the above-mentioned description, although the explanation has been made with respect to the case in which the gray-scale voltages of 64 gray scales are selected, it is needless to say that the present invention is also applicable to a case which displays 256 gray scales in accordance with 8-bit display data and a case which displays 1024 gray scales in accordance with 10-bit display data.

The larger the bit number of the display data, the advantageous effect that the chip size of the semiconductor chip which constitutes the drain driver DD is reduced is enhanced.

Further, in the above-mentioned description, although eight gray-scale voltages are generated by the output amplifying circuit AMP1 in accordance with the lower-order three bits of the display data, the present invention is not limited to such a case and, assuming "m" as an integer of 2 or more, it is possible to generate $2^m$ pieces of gray-scale voltages by the output amplifying circuit AMP1 in accordance with the lower-order m bits of the display data.

Figure 12:
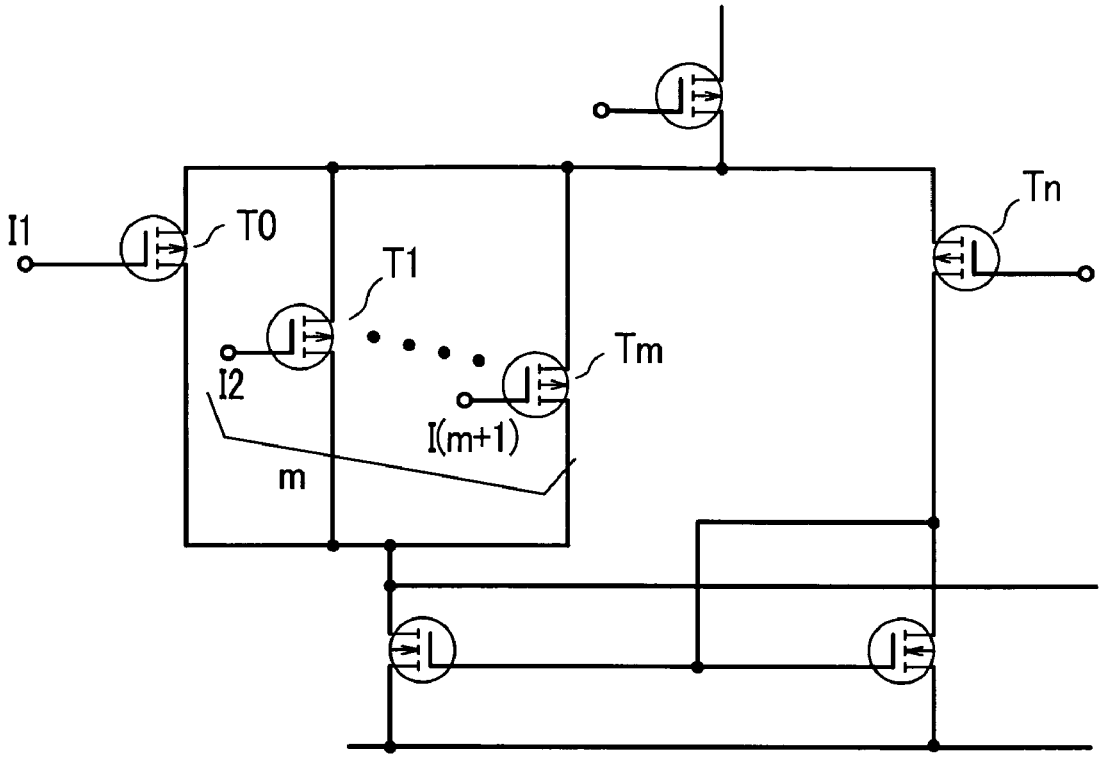
FIG. 12 is a circuit diagram showing a general circuit constitution of output amplifying circuit AMP1 of the present invention, when $2^m$ pieces of gray-scale voltages are generated with lower-order m bits of display data.

FIG. 12 shows the circuit constitution when $2^m$ pieces of gray-scale voltages are generated by the output amplifying circuit AMP1 in accordance with the lower-order m bits of the display data.

As shown in FIG. 12, m pieces of non-inverting terminals (I2 to I(m+1)) are provided, gate widths of gate electrodes of PMOS (T1 to Tm) which are connected to these m pieces of non-inverting terminals (I2 to I (m+1)) are set as $2^0$W, $2^1$W, . . . , $2^{(m-1)}$W respectively, and a gate width of a gate electrode of the PMOS (Tn) which constitutes a differential pair with the PMOS (T1 to Tm) is set as $2^m$W.

Here, W indicates the gate width of the gate electrode of the PMOS (T0) which is connected with a non-inverting terminal I1.

Further, in the above-mentioned description, although the explanation has been made with respect to the case in which the decoder circuit DEC1 and the output amplifying circuit AMP1 are constituted of the low-voltage decoder circuit NDEC and the low-voltage amplifying circuit NAMP respectively which output the gray scales of negative polarity, the present invention is not limited to the case and the present invention is applicable to a high-voltage decoder circuit PDEC and a high-voltage amplifying circuit PAMP which generate gray-scale voltages of positive polarity.

In case of the high-voltage decoder circuit, the NMOS in the decoder circuit DEC1 shown in FIG. 8 may be replaced with a PMOS.

Further, with respect to the high-voltage amplifying circuit, in the operational amplifier shown in FIG. 7, the NMOS which constitutes the differential pair may be replaced with the constitution shown in the above-mentioned FIG. 10 to FIG. 12.

Further, the present invention is also applicable to the decoder circuit of the drain driver driven by the common inversion method.

Further, in the above-mentioned description, although the explanation has been made with respect to the embodiments in which the present invention is applied to the liquid crystal display module, the present invention is not limited to the liquid crystal display panel and is also applicable to an EL display device which uses organic EL elements.

Although the invention made by inventors of the present invention has been specifically explained based on the embodiments, the present invention is not limited to the above-mentioned embodiments and various modifications are conceivable without departing from the gist of the present invention.

What is claimed is:

1. A display device comprising:

a display part having a plurality of pixels;

a plurality of video lines which apply gray-scale voltages to the plurality of pixels; and a drive part which supplies gray-scale voltages corresponding to display data to the plurality of video lines;

wherein display data is display data of n bits, and the drive part includes a gray-scale voltage generating circuit, assuming m (m being an integer of 2 or more) as a lower-order bit in accordance with n-bit display data, generates M pieces of gray-scale voltages where the gray scale number with respect to the gray-scale voltages is discontinuous, a decoder circuit which selects two neighboring gray-scale voltages out of M pieces of gray-scale voltages based on data of upper-order (n-m) bits in accordance with n-bit display data, and an output amplifying circuit which generates gray-scale voltages between two gray-scale voltages from two gray-scale voltages selected by the decoder circuit based on the data of lower-order m bits in accordance with n-bit display data and supplies the gray-scale voltages to the video lines;

wherein the output amplifying circuit includes an operational amplifier which has k (k≧3) pieces of non-inverting input terminals and one inverting input terminal, and a switching part which is provided between the decoder circuit and k pieces of non-inverting input terminals of the operational amplifier, and the inverting input terminal of the operational amplifier is connected to an output terminal of the operational amplifier, two gray-scale voltages which are selected by the decoder circuit are inputted to the switching part, and the switching part, based on the data of lower-order m bits in accordance with n-bit display data, selects two inputted gray-scale voltages and applies two inputted gray-scale voltages to k pieces of non-inverting input terminals of the operational amplifier such that the gray-scale voltages applied to the k pieces of non-inverting input terminals of the operational amplifier assume a given combination; and wherein the operational amplifier includes a differential amplifying circuit which constitutes an input stage, the differential amplifying circuit which constitutes the input stage includes at least one inverting-side transistor which has a control terminal thereof connected to the inverting input terminal, and k pieces of non-inverting-side transistors which constitute a differential pair with the at least one inverting-side transistor and have respective control terminals thereof connected to the respective non-inverting input terminals, and the weighting of an electrode width of control electrodes is applied to the k pieces of non-inverting-side transistors and at least one inverting-side transistor.

2. A display device according to claim 1, wherein an electrode width to which electrode widths of the control electrodes of k pieces of non-inverting-side transistors are added and an electrode width to which an electrode width of a control electrode of at least one non-inverting-side transistor is added are aligned with each other.

3. A display device comprising:

a display part having a plurality of pixels;

a plurality of video lines which apply gray-scale voltages to the plurality of pixels; and a drive part which supplies gray-scale voltages corresponding to display data to the plurality of video lines;

wherein display data is display data of n bits, and the drive part includes a gray-scale voltage generating circuit which, assuming m (m being an integer of 2 or more) as a lower-order bit in accordance with n-bit display data, generates $(2^{(n-m)}+1)$ pieces of gray-scale voltages, a decoder circuit which selects two neicihborinci gray-scale voltages out of $(2^{(n-m)}+1)$ pieces of gray-scale voltages based on data of upper-order (n-m) bits in accordance with n-bit display data, and an output amplifying circuit which generates given gray-scale voltages out of 2m pieces of gray-scale voltages between two gray-scale voltages from two gray-scale voltages selected by the decoder circuit based on the data of lower-order m bits in accordance with n-bit display data and outputs the gray-scale voltages to the video lines;

wherein the output amplifying circuit includes an operational amplifier which has (m+1) pieces of non-inverting input terminals and one inverting input terminal, and a switching part which is provided between the decoder circuit and (m+1) pieces of non-inverting input terminals of the operational amplifier, the inverting input terminal of the operational amplifier is connected to an output terminal of the operational amplifier, two gray-scale voltages which are selected by the decoder circuit are inputted to the switching part, and the switching part, based on the data of lower-order m bits in accordance with n-bit display data, selects two inputted gray-scale voltages and applies two inputted gray-scale voltages to (m+1) pieces of non-inverting input terminals of the operational amplifier such that the gray-scale voltages applied to the (m+1) pirces of non-inverting input terminals of the operational amplifier assume a given combination; and wherein the operational amplifier includes a differential amplifying circuit which constitutes an input stage, the differential amplifying circuit which constitutes the input stage includes at least one inverting-side transistor which has a control terminal thereof connected to the inverting input terminal, and (m+1) pieces of non-inverting-side transistors which constitute a differential pair with the at least one inverting-side transistor and have respective control terminals thereof connected to the respective non-inverting input terminals, and the weighting of an electrode width of control electrodes is applied to the (m+1) pieces of non-inverting-side transistors and the inverting-side transistor.

4. A display device according to claim 3, wherein an electrode width to which electrode widths of the control electrodes of (m+1) pieces of non-inverting-side transistors are added and an electrode width to which an electrode width of a control electrode of at least one non-inverting-side transistor is added are aligned with each other.

5. A display device according to claim 4, wherein assuming the electrode width of the transistor having the smallest electrode width of the control electrode in the (m+1) pieces of non-inverting-side transistors as W, the (m+1) pieces of non-inverting-side transistors are (m+1) pieces of transistors which have the electrode widths of the control electrodes of W, W, 2×W, . . . $2^{(m-1)}$×W, and the electrode width to which an electrode width of the control electrode of at least one inverting-side transistor is added is $2^m$×W.

6. A display device according to claim 4, wherein m is 3, and assuming an electrode width of the transistor having the smallest electrode width of the control electrode in 4 pieces of non-inverting-side transistors as W, 4 pieces of non-inverting-side transistors are 4 pieces of transistors having an electrode width W of the control electrode, an electrode width 2W of the control electrode, an electrode width 4W of the control electrode, and an electrode width 8W of the control electrode, and at least one inverting-side transistor is one transistor having an electrode width 8W of the control electrode.

* * * * *